US011623667B2

(12) United States Patent
Larsson et al.

(10) Patent No.: US 11,623,667 B2
(45) Date of Patent: Apr. 11, 2023

(54) WHEEL ASSEMBLY FOR A VEHICLE GUIDED ON A RAILWAY TRACK

(71) Applicant: MEDELA HOLDING AG, Baar (CH)

(72) Inventors: Göran Larsson, Zug (CH); Michael Stalder, Basel (CH)

(73) Assignee: MEDELA HOLDING AG, Baar (CH)

( * ) Notice: Subject to any disclaimer, the term of this patent is extended or adjusted under 35 U.S.C. 154(b) by 1069 days.

(21) Appl. No.: 16/319,255

(22) PCT Filed: Jul. 14, 2017

(86) PCT No.: PCT/EP2017/067839
§ 371 (c)(1),
(2) Date: Jan. 18, 2019

(87) PCT Pub. No.: WO2018/015290
PCT Pub. Date: Jan. 25, 2018

(65) Prior Publication Data

US 2019/0283785 A1 Sep. 19, 2019

(30) Foreign Application Priority Data

Jul. 19, 2016 (CH) ..... 00930/16

(51) Int. Cl.
*B61F 3/16* (2006.01)
*B61F 5/38* (2006.01)
*B61F 5/52* (2006.01)

(52) U.S. Cl.
CPC ..... *B61F 3/16* (2013.01); *B61F 5/383* (2013.01); *B61F 5/52* (2013.01)

(58) Field of Classification Search
CPC ..... B61F 3/16; B61F 5/383; B61F 5/52
See application file for complete search history.

(56) References Cited

U.S. PATENT DOCUMENTS 1,262,796 A * 4/1918 Holt ..... B61F 3/16 295/33
2,042,623 A * 6/1936 Montrose-Oster ..... B61D 13/00 105/169

(Continued)

FOREIGN PATENT DOCUMENTS

CN 1120329 A 4/1996
CN 1370121 A 9/2002

(Continued)

OTHER PUBLICATIONS

The International Search Report (ISR) with Written Opinion for PCT/EP2017/067839 dated Aug. 9, 2017, pp. 1-11.
The Written Opinion of the International Searching Authority for PCT/EP2017/067839 dated Aug. 9, 2017, pp. 1-6.

*Primary Examiner* — Zachary L Kuhfuss
(74) *Attorney, Agent, or Firm* — GrowIP Law Group LLC

(57) ABSTRACT

The invention concerns a vehicle guided on a railway track comprising a chassis and at least one wheel assembly interconnected to the chassis and a method for steering said vehicle. The wheel assembly comprises a cross-member having a first end to which a first hub is interconnected by a first steering joint and a second end to which a second hub is interconnected by a second steering joint. A first wheel is attached to the first hub rotatable around a first rotation axis and a second wheel is attached to the second hub rotatable around a second rotation axis. A first sensor determines the lateral position of the first sensor with respect to the rail. The first sensor is attached to the first hub and is, with respect to a direction of travel arranged in front of the supporting area of the first wheel in a horizontal direction spaced a distance A1 apart. The first sensor is interconnected to an actuator by a control unit which calculates a steering angle for the at least one interconnected wheel depending on the determined position of the first sensor.

27 Claims, 4 Drawing Sheets

(56) References Cited

U.S. PATENT DOCUMENTS

| | | | | | |
|---|---|---|---|---|---|
| 3,334,596 | A * | 8/1967 | Suri | B61F 3/16 | 105/180 |
| 3,793,966 | A * | 2/1974 | Swoager | B61F 3/16 | 105/364 |
| 4,022,133 | A * | 5/1977 | Lindblom | B61G 5/02 | 105/157.1 |
| 4,064,809 | A * | 12/1977 | Mulcahy | B61F 3/08 | 105/167 |
| 4,658,734 | A * | 4/1987 | Mroz | B61F 3/16 | 105/169 |
| 4,982,671 | A * | 1/1991 | Chollet | B61F 5/383 | 105/168 |
| 2017/0113706 | A1* | 4/2017 | Sanchez | B61F 5/52 | |
| 2017/0341662 | A1* | 11/2017 | Rackl | B61F 5/325 | |
| 2019/0084592 | A1* | 3/2019 | Hashimoto | B61F 5/06 | |
| 2019/0283785 | A1* | 9/2019 | Larsson | B61F 5/383 | |
| 2020/0180358 | A1* | 6/2020 | Fenaroli | B61F 3/04 | |

FOREIGN PATENT DOCUMENTS

| | | | | |
|---|---|---|---|---|
| CN | 204236484 | U | 4/2015 | |
| DE | 40 40 303 | A1 | 6/1992 | |
| DE | 4231346 | A1 | 3/1994 | |
| DE | 42 40 720 | A1 | 6/1994 | |
| DE | 199 18 071 | C1 | 7/2000 | |
| DE | 102011077750 | A1 | 12/2012 | |
| EP | 1867543 | A2 * | 12/2007 | B61C 9/50 |
| GB | 2 486 272 | A | 6/2012 | |
| JP | H06504502 | A | 5/1994 | |
| JP | H08506295 | A | 7/1996 | |
| JP | 2010221950 | A | 10/2010 | |
| JP | 2014510860 | A | 5/2014 | |
| RU | 2294297 | C1 | 2/2007 | |
| RU | 2570520 | C1 | 12/2015 | |
| WO | WO2016098316 | A1 | 6/2016 | |

* cited by examiner

WHEEL ASSEMBLY FOR A VEHICLE GUIDED ON A RAILWAY TRACK

CROSS-REFERENCE TO RELATED APPLICATIONS

This application claims the benefit of the filing date of international PCT Application No. PCT/EP2017/067839, filed on Jul. 14, 2017 that in turn claims priority to Swiss Patent Application No. CH 00930/16, filed on Jul. 19, 2016, which are hereby incorporated by reference in their entirety.

FIELD OF THE INVENTION

The present invention is directed to a steerable wheel assembly as defined by the claims and a vehicle guided on a railway track comprising such a steerable wheel assembly.

BACKGROUND OF THE INVENTION

Track-bound vehicles such as trains or trams often exhibit wheels that are not optimally aligned to the tracks leading to higher friction between the track and the wheel's rim. Especially in curves with a small radius, this contact leads to an increased profile wear and noise pollution. In case of low-floor vehicles this effect is even more pronounced: The low-floor vehicles feature smaller and less wheels per vehicle in order to increase the passenger comfort and inner space of the vehicle by having a continuous low-floor structure. However, this further leads to enhanced loads per wheel and a more pronounced fatigue of the wheel's material causing smaller rifts or even larger material fractures.

Several solutions are known to reduce the track and wheel wear. In the 1990's, systems have been developed that were able to steer the wheels in curves. However, it turned out that these solutions often suffered from undesired side effects in straight track sections such that the wheels adhered one-sided with the rim on the track, leading to an enhanced wear and noise in straight track sections. Hence, after a few years, most of these concepts were discarded and conventional concepts combined with wheel-noise absorbers and advanced industrial lubricants were again pursued.

One example of the subject-matter is the document DE4231346, published on the 24.03.1994 by Siemens AG, which concerns a rail course measurement device with at least one inductive sensor arrangement and computing unit. A sensor arrangement for each individual wheel detects a change in inductance corresponding to the change of the position of the rail. The sensor arrangement can contain at least one sensor in front of and one behind the associated wheel and incorporates a magnetic carrier that is fixed on a telescope-pendulum which is rotatably suspended. Hence, the magnetic sensor can move in a horizontal plane and follow the direction of the rail.

DE102013001973, published on the 16.01.2016 by Josef Staltmeir, relates to concepts for high-speed trains, where the guide has sensors i.e. distance sensors for providing measured signals about an operational behavior of a driving module and a head bogie on a railway. The sensors are arranged inside a flange of a wheel and detect a lateral distance between the wheel's flange and a rail head. Values of the distances are compared with values of the middle deviation of the bogie to the track middle and transferred to a controller. Traction motors are controlled to optimize the behavior and backwardly guide the bogie into a central position. The sensors are designed as inertia sensors, signal transmitters or derailment detectors.

US2010294163A, published on the 23.10.2010 by the University of Paderborn, relates to a rail vehicle comprising a chassis provided with individual wheels which are respectively mounted on axle carriers in such a way that they can pivot in the horizontal direction about a vertical steering axis. The rail vehicle further comprises a steering actuator associated with each wheel, for adjusting a pre-determined steering angle about the vertical steering axis. Additionally, the wheels of the axles are mounted in such a way that they can be pivoted in the vertical direction about a horizontal camber axis and can be acted upon by means of a camber actuator in order to adjust a pre-determined camber angle.

SUMMARY OF THE INVENTION

In order to solve at least one of the aforementioned problems, a vehicle guided on a railway track comprises a chassis and at least one wheel assembly according to the invention interconnected to the chassis. The chassis comprises a cross-member having a first and a second end. A first hub is interconnected to the first end of the cross-member by a first steering joint swiveling about a first steering axis arranged in a vertical manner. At a second end of the cross-member a second hub is interconnected by a second steering joint comprising a joint shaft and a joint bushing. The steering joint allows a swiveling motion about a second steering axis arranged in a vertical manner.

The steering joint normally comprises a joint shaft and a joint bushing. The steering axis is orientated concentrically within the joint shaft around which the wheel is steerable. The joint shaft extends through a section of the cross-member in an essentially vertical manner and penetrates in a designated depression of the hub, interconnecting the hub and the cross-member. Preferably, the cross-member is arranged under a rotation axis of the wheel and the joint shaft is interconnected to the hub on the lower side of the same, since a low cross member is advantageous for low floor trams.

A first wheel is rotatably attached to the first hub around a first rotation axis. A second wheel is rotatably attached to the second hub around a second rotation axis. The first and the second wheel each comprise a rolling surface which during operation interacts with a rail of a railway track by a supporting area 44. The exact shape of the supporting area 44 depends among others on the surface shape of the running surface of the wheel and rail's and wheel's wear as well as the individual surface pressure. In a preferred variation the center distance between each steering axis and the center of the related supporting area 44 is within a maximum distance of 0.1 m.

Furthermore, a first sensor determines the lateral position of the first sensor (itself) with respect to the rail. The first sensor is attached to the first hub through a first sensor mounting. The first sensor is preferably arranged with respect to a direction of travel (x-direction) in front of the supporting area 44 of the first wheel in a horizontal direction spaced a distance A1 45 apart with respect to the center of the respective supporting area 44. Sensor adjustment means can be present by which the sensor can be adjusted in its position regarding the height above the rail (z-direction) and the lateral displacement to the rail (y-direction). Hereby, the sensor is placed at a height in a range of about 0.04 m-0.5 m above the rail.

The displacement in the direction of travel (x-direction) is fixed at the distance A. The range of A1 45 may be determined by taking half of the diameter of the wheel as a lower limit, meanwhile the upper limit is set due to the maximal availed space underneath the chassis and in front of the wheel. For a preferred variation of the invention, this range is between 0.1-1.2 m for the smaller wheel of low floor trams.

Furthermore, an actuator is interconnected to at least one of the first and the second wheel to swivel the at least one interconnected wheel around the respective steering axis by a steering angle. The first sensor is interconnected to the actuator by a control unit which calculates a correcting steering angle for the at least one interconnected wheel depending on the determined position of the first sensor.

In a variation of the invention, a second sensor is attached to the second hub by a second sensor mounting. The at least one sensor mounting is preferably designed as a mechanically rigid and stiff structure which prohibits extensive vibrations or oscillations of the sensor in respect to the hub by the sensor mounting. The second sensor is arranged with respect to the direction of travel (x-direction) in front of the supporting area 44 of the second wheel in a horizontal direction spaced a distance A2 apart with respect to the center of the related supporting area 44. The range of the distance A2 can be determined the same way as the range of the distance A1 45.

In a variation of the invention, the wheel assembly comprises a third sensor which is interconnected to the first hub wherein the third sensor is interconnected or directly attached to the first sensor mounting on the first wheel. However, a separated sensor mounting of the first and the third sensor is also possible with a sensor mounting, that is again made by a stiff structure to dampen vibrations or oscillations of the sensor with respect to the hub. The third sensor is arranged with respect to the direction of travel in the back of the supporting area 44 of the first wheel in a horizontal direction spaced a distance A3 apart with respect to the center of the related supporting area 44.

In a variation of the invention, the wheel assembly comprises a fourth sensor, which is interconnected to the second hub and which is arranged with respect to the direction of travel in the back of the supporting area 44 of the second wheel in a horizontal direction spaced a distance A4 apart with respect to the center of the respective supporting area 44.

The distances A1 through A4 take influence on the sensitivity of the overall system. Larger distances A1, A2 result in a more sensitive behavior of the overall system as slight changes in the position of the wheel result in a stronger deflection of the respective sensor. At the same time, the risk becomes larger that the sensor does not remain above the rail in case of curves with a particularly small radius. Good results can be achieved if the distances A1 through A4 are in the range of 0.1-1.2 m. By choosing the distance A1 45 and the distance A3, respectively A2 and A4, equal within the available tolerances a direction independent behavior can be achieved.

The first and the second hub may be directly interconnected to each other by a steering rod. This has the advantage that only one actuator can be used to steer both wheels at the same time. The steering rod can have a variable length to adjust during operation. A simple yet robust construction can be achieved when the actuator is attached to the cross-member and is in a transversal direction (y-direction) arranged between the two wheels of a wheel assembly.

In a preferred embodiment, to keep a wheel on track the at least one sensor measures its position with respect to an inner guiding edge and/or inner flank of the rail. Using an inner edge and/or flank of the rail as a primary guiding means is advantageous since they are determinable even under harsh conditions, e.g. snow etc. However, in the case of a rail comprising a groove as a guiding means for the wheel flanges, the groove as such or details thereof can be used as a guiding means for the at least one sensor. Hereby the at least one sensor determines its position with respect to at least one upper edge and/or at least one flank of the groove to orientate itself.

Switching of the controlling guiding means during operation and/or combining signals of different sensors to determine the controlling guiding means is possible if the condition requires it. E.g. it is possible to use different sensor combinations and the thereto related signals if running on a straight track or in a curve. Moreover it is possible to use different modes at the same time, e.g. with comparatively long vehicles which are partially on a straight track and partially in a curved area. On a straight track it can be sufficient if—with respect to the running direction of the vehicle—only the leading sensors are active and in curves both leading and trailing sensors are under control. By interconnection of several sensors by a control unit it becomes even possible that per wheel assembly in a curve only the curve inner or the curve outer sensors become active. Interpolation of the wheels of a wheel assembly becomes possible over the length of a vehicle namely in the case of a difficult track situation, e.g. by crossing junction plates.

The at least one sensor may be an inductive sensor and/or a laser sensor and/or a capacitive sensor and/or an ultrasonic sensor and/or an optical sensor, wherein the at least one sensor is arranged contactless to the rail. Furthermore, in certain conditions laser edge sensors have proven to be a good means to accurately detect the distance to an object's edge. Generally, these systems are based on a laser line being projected by the sensor, reflected from the edge and/or surface and collected by a receiver. Exact distances to the edge and/or surface are then calculated from these signals by means of underlying algorithms.

Good results can be achieved if the sensor is arranged 0.04-0.5 m above the rail in order to allow a certain clearance between the rail and the sensor. At least one sensor may be equipped by a protection means which is positioned in front of the at least one sensor in respect of the direction of travel. The protection means protects the sensor from damages by environmental influences and/or contamination and/or fragments which lie on the railway. To circumvent a collision of the sensors with possible interfering pieces the protection means have preferably a clearance means such as a shovel that guides possible interfering pieces away from the rail and thus away from the sensors.

In a variation of the wheel assembly according to the invention, each wheel is interconnected to a brake disc wherein the brake disc is arranged outside of the wheel. Furthermore, a driving motor may be preferably arranged outside of the wheel and is interconnected to the wheel by a gear box. Hereby, a rotation axis of the brake disc is arranged at an angle with respect to the rotation axis of the respective wheel. However, it is also possible to arrange the brake disc inside of a wheel being interconnected to a brake caliper attached to the respective hub.

A control unit is interconnected to the at least one sensor, the actuator and a steering unit. The control unit receives data from the at least one interconnected sensor. It compares the data received from the at least one sensor with a predefined parameter. As soon as the measured value of the at least one sensor deviates by a certain value from the predefined parameter, it activates the actuator to counter-steer. As a result, the upcoming measured values by the at least one sensor should be altered so that the deviation to the predefined parameter is reduced. In the case of multiple sensors, multiple predefined parameters for each sensor are possible. Furthermore, each predefined parameter may further be interconnected to at least one other predefined parameter and/or may be dependent on multiple sensors.

If appropriate, a fifth sensor may be present which is interconnected to a chassis and to the control unit. Wherein the control unit determines out of the measured quantities of the fifth sensor a track type and/or a track curvature and/or track anomalies of the rails in front of the wheel assembly in the direction of travel.

Additionally or supplementary, the control unit may be interconnected to a position determining system which provides information about the position of the wheel assembly along the rail, such as e.g. a GPS sensor. The fifth sensor relays the position to the control unit, which reverts to a stored data-set with information of the rails. In that way the track type and/or the track curvature and/or the track anomalies of the rails in front of the wheel assembly in the direction of travel can be retrieved. The data of the upcoming track status may be used for presetting certain control strategies such as for a change of the curve radii or of the track type. A chassis of a vehicle guided on a railway track normally comprises at least two wheel assemblies as described above. The rolling surface of the wheel may be e.g. conical or cylindrical or barrel-shaped. Depending on the field of application, a multiple set of wheel assemblies is also possible which are linked to each other by the control unit. By linking the sensors of the wheel assemblies to each other a very robust and self-stabilizing behavior can be achieved.

Alternatively or in addition, a sensor array can be used instead of a single sensor to enhance e.g. the accuracy. The array may be structured as a matrix (n×m), whereby preferably the columns of the matrix (m) are arranged perpendicular and the rows (n) parallel to the respective wheel. During operation, some sensors of the array may be above the rail sensing its position, meanwhile other sensors may be next to the rail. In that way, the exact position of the rail in front of the wheel can be determined through interpolation of information of the multiple sensors. A less complex system would be, if instead of the whole matrix, only the diagonal of the matrix is implemented with sensors, so that still information in width (direction perpendicular to the rail) and in amplitude (direction in line with the wheel) are available. Alternatively, either the number of rows (n) or the number of columns (m) are equal to a value of one so that the dimension of the matrix is reduced. If the number of rows are equal to one, the remaining one row is placed in front of the wheel and above the (preferably inner) edge of the rail. In a curve, the sensor farthest away from the wheel will be the first to lose its position above the rail and hence lose the information about where the rail is placed exactly. However, for small radii, the sensor farther away from the wheel will have a higher accuracy than the sensors being right in front of the wheel. The information of all sensors, which are in a curve essentially above the rail, can be used and interpolated by the control unit to calculate an appropriate control signal/correcting steering angle for the actuator. In case of only a single column of sensors, the accuracy is dependent on the distance in front of the wheel as well as the distance between the sensors of the column.

Using at least one wheel assembly on a chassis of a vehicle guided on a railway track, as described above, the method comprising the following steps may be applied for steering a chassis of a track guided vehicle: a) Measuring a displacement of at least one sensor with respect to a neutral position where a center of the at least one sensor is above an inner guiding edge of a rail, b) communicating the measured displacement to a control unit inter-connected to the at least one sensor, c) calculating a correcting steering angle by a control unit wherein the correcting steering angle is determined out of the measured displacement of the at least one sensor, d) communicating the calculated correcting steering angle to at least one actuator interconnected to at least one wheel and the control unit, e) swiveling at least one interconnected wheel around a respective steering axis by the correcting steering angle by at least one actuator so that the at least one sensor is in a target position, where a flange of the at least one interconnected wheel has a target displacement to the inner guiding edge of the rail. The target displacement of the flange to the inner guiding edge of the rail can be chosen. The range is advantageously of about 0.001 m-0.06 m. It is understood, that the target displacement does not necessarily have to be a fixed value. Since the distance of the rails in a curve do vary dependent on the radius of the curve, the optimal target displacement, implying the wheel assembly being in the center between the rails with the same distance of the wheel flanges to the respective rail, may vary as well.

Alternatively, a second sensor may be interconnected to the wheel assembly, so that in front of the first and the second wheel, which are interconnected to each other via a steering rod, an additional sensor is present. In this case, both sensors have an individual neutral position to which a displacement is measured and communicated to the control unit. The control unit advantageously calculates the target positions out of the mean of the measured displacements of the first and the second sensor. However, more complex calculation methods to determine each target displacement of the individual sensor may be applied. For a simple algorithm however, it is advantageous that the target displacements of the sensors to the respective inner guiding edge of the rail are equal.

As described above, in one variation a third sensor may be attached behind the first wheel and a fourth sensor may be attached behind the second wheel. Hereby, each sensor measures individually its displacement in respect to an individual neutral position and communicates the same to the control unit. The control unit may then further use the measured displacements of the first and the second sensor to calculate first target positions of the first and the second sensor, wherein the absolute value of the displacements of the first sensor and the second sensor are advantageously equal. Furthermore, the measured displacements of the first and the third sensor may be used to calculate second target positions of the first and the third sensor, wherein the displacements of the first and the third sensor are also advantageously equal. Additionally, the measured displacements of the second and the fourth sensor may be used to calculate third target positions, wherein the displacements of the second and the fourth sensor are advantageously equal. From this information the control unit may determine a correcting steering angle by which the actuator steers the first and the second wheel in a defined position, wherein in the defined position the first and second sensor are in one of the first target positions and the first and third sensor are in one of the second target positions and the second and fourth sensor are in one of the third target positions.

BRIEF DESCRIPTION OF THE DRAWINGS

The herein described invention will be more fully understood from the detailed description of the given herein below and the accompanying drawings, which should not be considered as limiting to the invention described in the appended claims.

DETAILED DESCRIPTION OF THE INVENTION

The foregoing summary, as well as the following detailed description of the preferred variations of the invention, are better understood when read in conjunction with the appended drawings. For the purposes of illustrating the invention, an embodiment that is presently preferred, in which like numerals represent similar parts throughout the several views of the drawings, it being understood, however, that the invention is not limited to the specific methods and instrumentalities disclosed.

Figure 1:
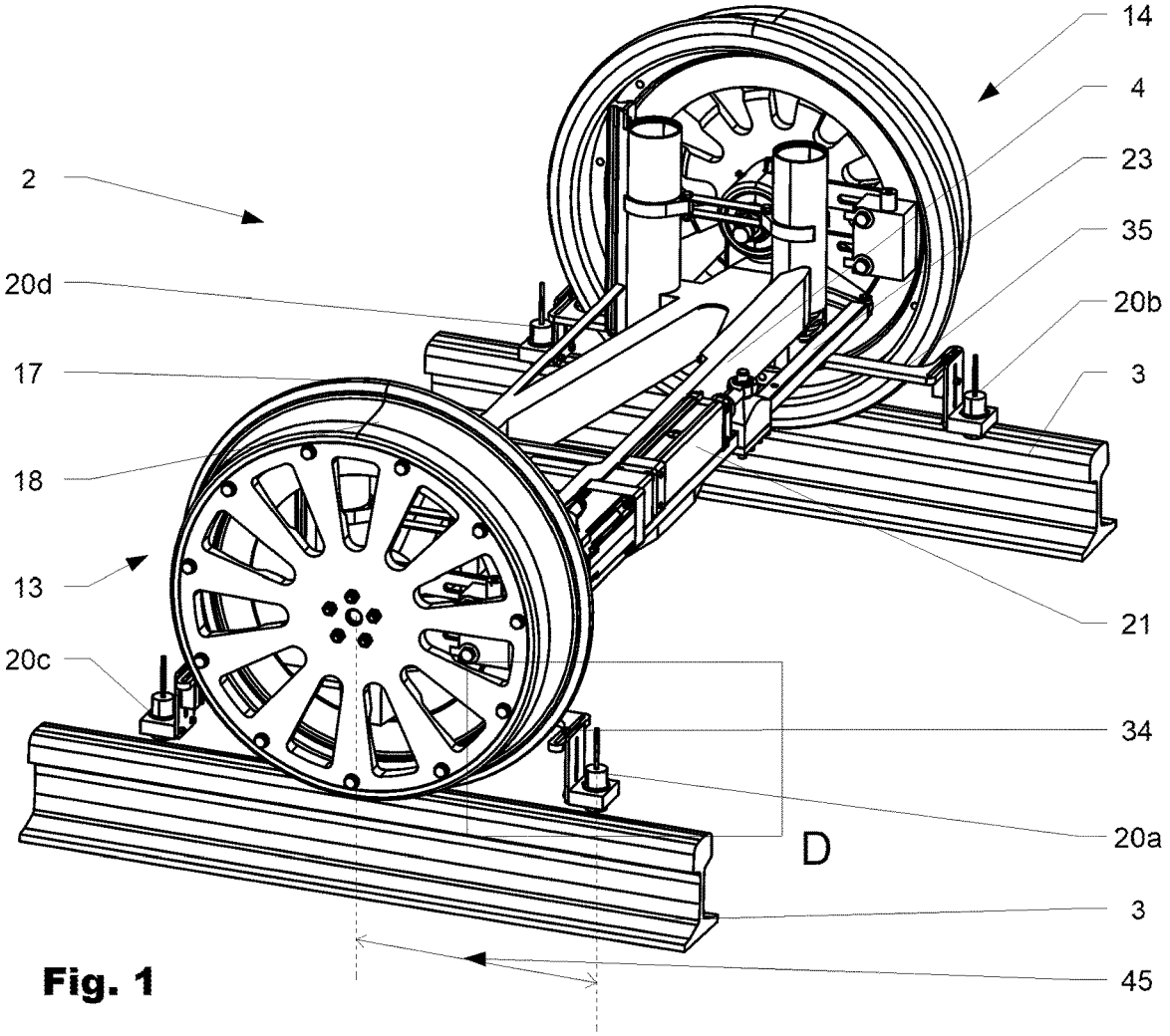
FIG. 1 schematically shows a first variation of a steerable axle according to the present invention in a perspective view.

FIG. 1 shows a first variation of the wheel assembly 2 according to the invention. The wheel assembly 2 comprises a first and a second wheel 13, 14, each with a wheel flange 17 and wheel rolling surface 18. Each wheel 13, 14 turns around a rotation axis 15, 16 and can be swiveled around a steering axis 11, 12. Both steering axes 11, 12 are orientated above the corresponding rail and in the region of the supporting point 19 between each wheel 13, 14 and the corresponding rail 3. The steerable wheels 13, 14 are further interconnected to a cross member 4 and a steering rod 23. Through the steering rod 23, an actuator 21 can steer both wheels 13, 14 simultaneously. The actuator 21 is attached to the cross-member 4 and is placed between the two wheels 13, 14. In front of and behind each wheel 13, 14 a sensor 20*a-d* is placed, which is attached to the hub 7, 8 of the wheel 13, 14 through a sensor mounting 34, 35. Hence, if the wheel 13, 14 has a certain angle in respect to the rail 3, the sensors 20*a-d* are inclined together with the wheel 13, 14. The sensors 20*a-d* sense its position in respect to an inner guiding edge 24 and/or flank of the rail 3 underneath the same and therefore gains a measure for the angle of the wheel to the respective rail 3. In this case, the sensors 20*a-d* are inductive sensors, however, other sensing means such as e.g. laser and/or optical sensors are possible.

Figure 2:
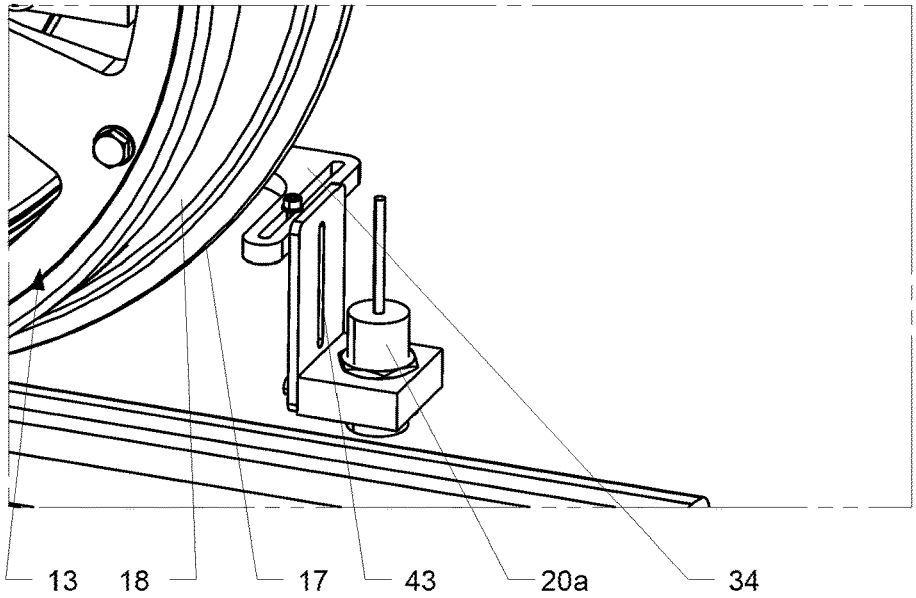
FIG. 2 shows a detail of FIG. 1.

FIG. 2 shows a detail view (detail D) of the sensor arrangement of sensor 20*a* of FIG. 1. The first sensor 20*a* is interconnected to a first sensor mounting 34 which is interconnected to the steerable wheel 13. The height and lateral displacement of the first sensor 20*a* in respect to the rail 3 can be adjusted through sensor adjustment means 43.

Figure 3:
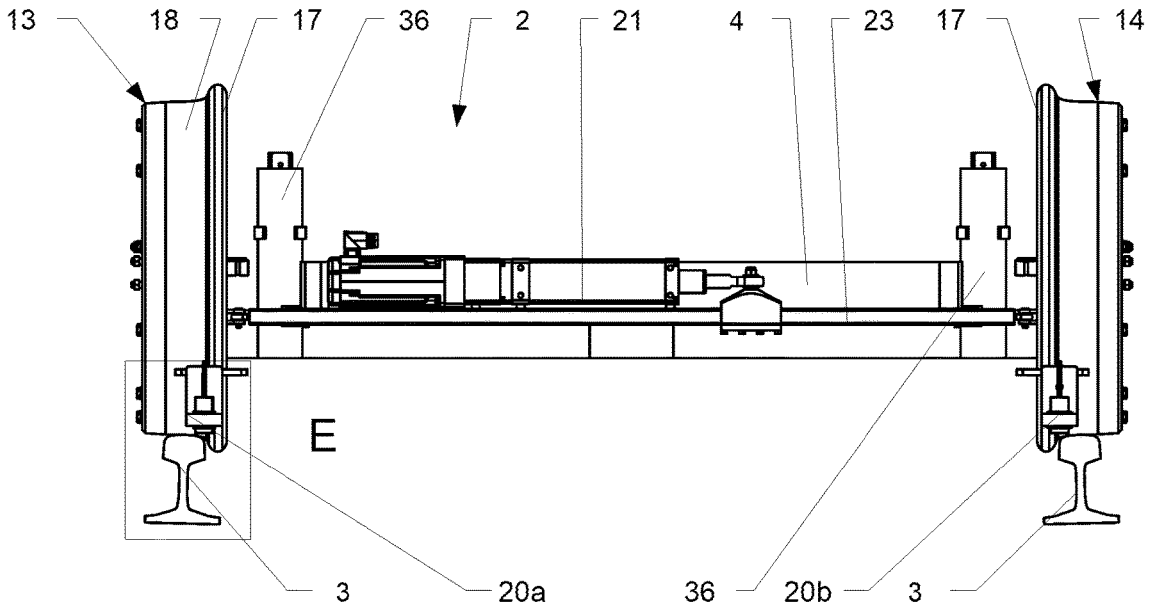
FIG. 3 schematically shows the first variation of the steerable axle according to the present invention in a front view.
Figure 4:
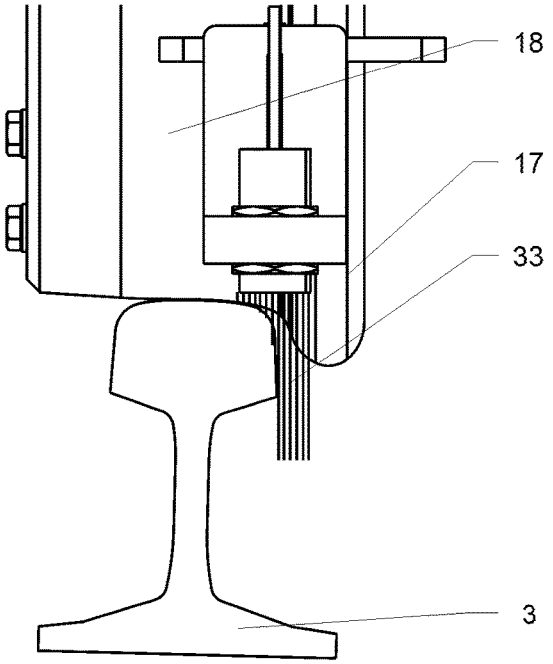
FIG. 4 shows a detail of FIG. 3.

FIG. 3 shows the wheel assembly 2 in a front view, meanwhile FIG. 4 depicts the details of FIG. 3 of the first sensor mounting 34 and the position of the first sensor 20*a*. Here, the exact placement of the first sensor 20*a* in respect to the rail 3 can be seen in a neutral position. With help of the adjustment means 43, the sensor 20*a* is orientated substantially central above the inner guiding edge of the rail 24 in a height preferably between 0.04 m and 0.5 m. The magnetic field 33 from the inductive sensor 20*a* reaching to the rail 3 is illustrated schematically.

Figure 5:
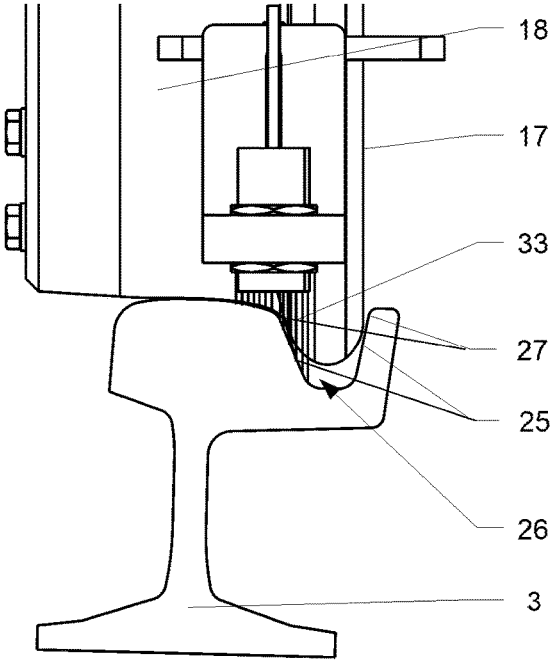
FIG. 5 shows a variation of the invention derived from FIG. 4.

FIG. 5 shows a rail 3 with a groove 25 in which the flange 17 of a wheel 13, 14 is guided. The groove 25 is formed by two flanks 27 and two upper edges of the groove 26. In the case of a grooved railway, the wheel assembly 2 is steered by means of at least one sensor 20 that measures its position in respect to the groove 25. Hereby the sensor may use either upper edges 24 as reference and/or the flanks 27 of the groove 25. Switching of the relevant references and/or combining signals of different sensors is possible if the condition requires it.

Figure 6:
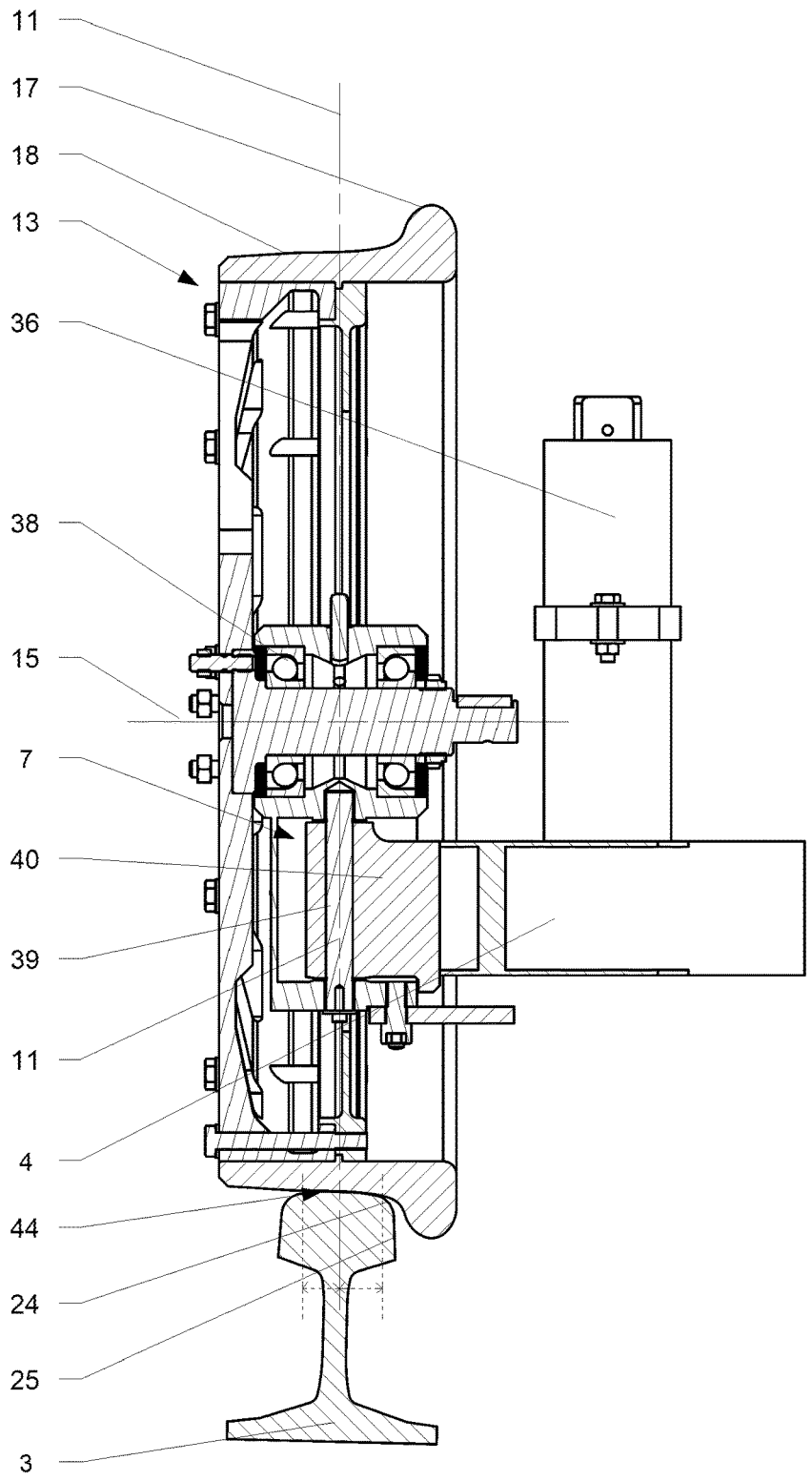
FIG. 6 shows a cross-section of the steerable axle of FIGS. 1 and 3.

FIG. 6 depicts a section view of the first wheel 13 comprising the wheel's rolling surface 18 as well as the wheel flange 17 and wheel spokes 42 turning around a first rotational axis 15. The wheel 13 further comprises a first hub 7 which is not turning around the first rotational axis 15. Therefore, wheel bearings 38 are placed on the first hub 7. The first hub 7 is further interconnected to the cross-member 4 through a first steering joint 9 which comprises a joint shaft 39 and a joint bushing 40 around which the wheel 13 is steerable. This is further indicated by the first steering axis 11 which is placed concentrically within the joint shaft 39. The joint shaft 39 extends through a section of the cross-member 4 and penetrates in a designated depression of the first hub 7. On the cross-member 4 spring assemblies 36 are arranged. Furthermore, the interconnection of the first sensor mounting 34 to the first hub 7 can be seen; meanwhile the interconnection of the wheel 13 to the steering rod 23 to steer the wheel 13 around the first steering axis 11 cannot be seen in this section view.

Figure 7:
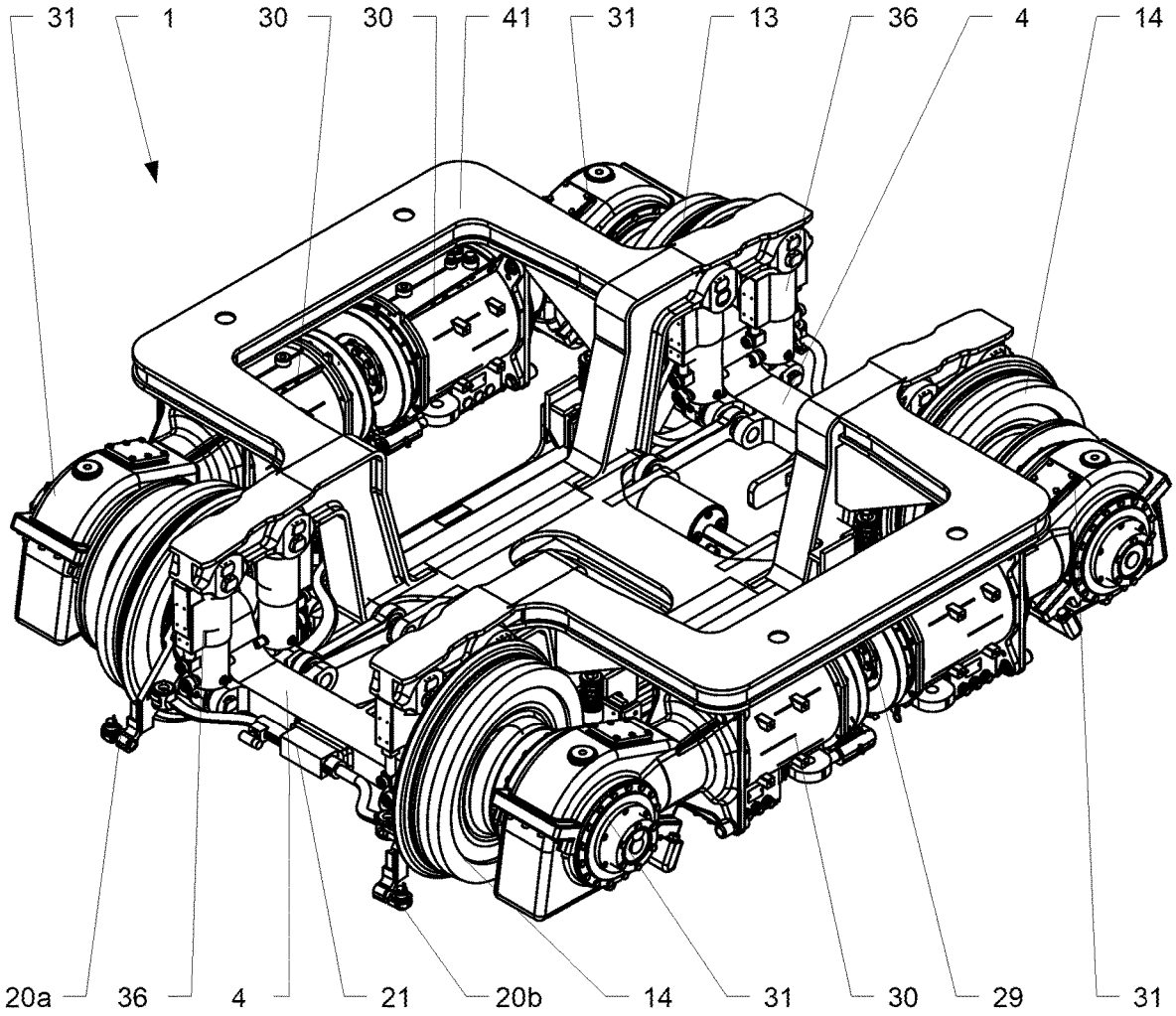
FIG. 7 schematically shows a second variation with a chassis comprising two steerable axles according to the present invention in a perspective view.
Figure 8:
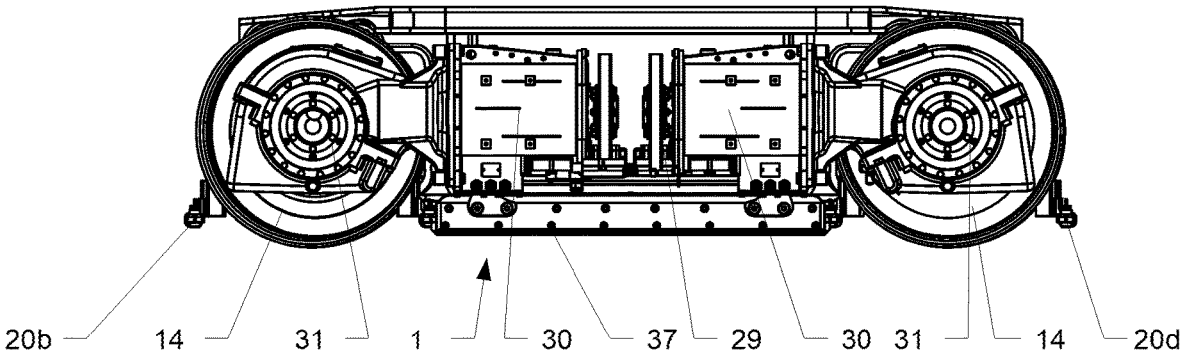
FIG. 8 schematically shows the chassis of FIG. 6 in a side view.

FIG. 7 and FIG. 8 illustrate the chassis 1 comprising two wheel assemblies 2 according to the invention. On each wheel assembly 2 spring assemblies 36 are attached on the cross-member 4 and a frame 41 is embedded on the spring assemblies 36 of each wheel assembly 2. On both outer sides of the wheel assembly 2, gear boxes 31 are arranged and interconnected to the wheels 13, 14. Driving motors 30 are interconnected to a first end to the gear boxes 31 in a way that the driving motors are placed in-between the two gear boxes 31 on either side of the chassis 1. Hence, the rotational axis of the driving motors 30 and the rotational axis 15, 16 of the wheels 13, 14 are essentially perpendicular to each other and the gearbox 31 is a right angle gear box. A brake disc 29 is interconnected to a second end of each driving motor 30 so that the two brake discs 29 of the two wheels 13, 14 on one rail 3 are in close proximity facing each other. An electromagnetic rail brake 37 is placed underneath the two driving motors 30 on each side of the chassis 1 (on each rail 3) between the two wheels 13, 14.

The invention claimed is:

1. A vehicle guided on a railway track comprising a chassis and at least one wheel assembly interconnected to the chassis comprising:

a. a static cross-member having i. a first end to which a first hub is interconnected by a first steering joint swiveling about a first steering axis arranged in a vertical manner, ii. a second end to which a second hub is interconnected by a second steering joint swiveling about a second steering axis arranged in a vertical manner, and b. a first wheel attached to the first hub rotatable around a first rotation axis and a second wheel attached to the second hub rotatable around a second rotation axis, c. the first wheel and the second wheel each comprise a rolling surface which during operation interacts with a rail of a railway track by a supporting area, wherein a center distance between each steering axis and a center of the related supporting area is within a maximum distance of 0.1 m, and d. a first sensor to determine a lateral position of the first sensor with respect to the rail, i. said first sensor being attached to the first hub, ii. said first sensor being arranged with respect to a direction of travel in front of the supporting area of the first wheel in a horizontal direction spaced a distance A1 apart with respect to the center of the respective supporting area, wherein the distance A1 is in the range of 0.1-1.2 m e. an actuator interconnected to at least one of the first wheel and the second wheel to swivel the at least one interconnected wheel around the respective steering axis by a steering angle, wherein the at least one interconnected wheel comprises the first wheel, the second wheel, or both the first wheel and the second wheel, and f. the first sensor is interconnected to the actuator by a control unit which calculates a steering angle for the at least one interconnected wheel depending on the determined lateral position of the first sensor.

2. The vehicle guided on the railway track according to claim 1, wherein the at least one wheel assembly comprises a second sensor which is attached to the second hub, said second sensor being arranged with respect to the direction of travel in front of the supporting area of the second wheel in a horizontal direction spaced a distance A2 apart with respect to the center of the related supporting area.

3. The vehicle guided on the railway track according to claim 2, wherein the at least one wheel assembly comprises a third sensor which is attached to the first hub, the third sensor being arranged with respect to the direction of travel in back of the supporting area of the first wheel in a horizontal direction spaced a distance A3 apart with respect to the center of the related supporting area.

4. The vehicle guided on the railway track according to claim 3, wherein the distance A1 and the distance A3 are equal.

5. The vehicle guided on the railway track according to claim 3, wherein the at least one wheel assembly comprises a fourth sensor which is attached to the second hub, said fourth sensor being arranged with respect to the direction of travel in back of the supporting area of the second wheel in a horizontal direction spaced a distance A4 apart with respect to the center of the respective supporting area.

6. The vehicle guided on the railway track according to claim 5, wherein the at least one wheel assembly comprises a fifth sensor which is interconnected to the chassis and to the control unit, wherein the control unit determines out of measured quantities of the fifth sensor one or more of a track type, a track curvature, and track anomalies of the rails in front of the wheel assembly in the direction of travel.

7. The vehicle guided on the railway track according to claim 1, wherein the first hub and the second hub of the at least one wheel assembly are interconnected to each other by a steering rod.

8. The vehicle guided on the railway track according to claim 1, wherein the actuator of the at least one wheel assembly is interconnected to the cross-member.

9. The vehicle guided on the railway track according to claim 1, wherein the actuator of the at least one wheel assembly is in a transversal direction arranged between the wheels of a wheel assembly.

10. The vehicle guided on the railway track according to claim 1, wherein the first sensor of the at least one wheel assembly measures the lateral position of the first sensor with respect to an inner guiding edge or flank of the rail.

11. The vehicle guided on the railway track according to claim 10, wherein the rail comprises a groove acting as the inner guiding edge for the first sensor.

12. The vehicle guided on the railway track according to claim 11, wherein the first sensor of the at least one wheel assembly determines the lateral position of the first sensor with respect to one or more of at least one upper edge and at least one flank of the groove.

13. The vehicle guided on the railway track according to claim 1, wherein the first sensor of the at least one wheel assembly is one or more of an inductive sensor, a laser sensor, a capacitive sensor, an ultrasonic sensor, an optical sensor, and a radar sensor.

14. The vehicle guided on the railway track according to claim 1, wherein the sensor of the at least one wheel assembly has a protection means which is positioned in front of the first sensor in respect of the direction of travel.

15. The vehicle guided on the railway track according to claim 1, wherein the first sensor of the at least one wheel assembly is arranged in a height of about 0.04 m-0.5 m above the rail.

16. The vehicle guided on the railway track according to claim 1, wherein the first wheel of the at least one wheel assembly is interconnected to a first brake disc, wherein the first brake disc is arranged outside of the first wheel, and wherein the second wheel of the at least one wheel assembly is interconnected to a second brake disc, wherein the second brake disc is arranged outside of the second wheel.

17. The vehicle guided on the railway track according to claim 1, wherein the at least one wheel assembly comprises (i) a first driving motor which is arranged outside of the first wheel and is interconnected to the first wheel by a first gear box and (ii) a second driving motor which is arranged outside of the second wheel and is interconnected to the second wheel by a second gear box.

18. The vehicle guided on the railway track according to claim 16, wherein the at least one wheel assembly comprises (i) a rotation axis of the first brake disc which is arranged at an angle with respect to the rotation axis of the first wheel and (ii) a rotation axis of the second brake disc which is arranged at an angle with respect to the rotation axis of the second wheel.

19. The vehicle guided on the railway track according to claim 1, wherein the at least one wheel assembly comprises (i) a first brake disc which is arranged inside of the first wheel and a thereto interconnected first brake caliper and is attached to the first hub, and (ii) a second brake disc which is arranged inside of the second wheel and a thereto interconnected second brake caliper and is attached to the second hub.

20. The vehicle guided on a railway track according to claim 1, wherein the control unit is interconnected to a position determining system which provides information to the control unit about a position of the wheel assembly along the rail.

21. The vehicle guided on the railway track according to claim 20, wherein the control unit uses information on the position of the wheel assembly to revert to a stored data-set.

22. The vehicle guided on the railway track according to claim 1, wherein the rolling surface of each of the first wheel and the second wheel is conical or cylindrical or barrel-shaped.

23. The vehicle guided on the railway track according to claim 1, further comprising at least two wheel assemblies, wherein the first sensor of the first wheel assembly is interconnected to the first sensor of the second wheel assembly by the control units.

24. A method for steering a track guided vehicle comprising:

a. Providing the track guided vehicle as defined in claim 1;

b. Measuring a displacement of the first sensor with respect to a neutral position where a center of the first sensor is above an inner guiding edge of the rail;

c. Communicating the measured displacement to the control unit interconnected to the first sensor;

d. Calculating a correcting steering angle by the control unit, wherein the correcting steering angle is determined out of the measured displacement of the first sensor;

e. Communicating the calculated correcting steering angle to the actuator interconnected to at least one of the first wheel and the second wheel and the control unit; and f. swiveling at least one interconnected wheel around a respective steering axis by the correcting steering angle by the actuator so that the first sensor is in a target position, where a flange of the at least one interconnected wheel has a target displacement to the inner guiding edge of the rail.

25. The method according to claim 24, wherein the target displacement of the flange to the inner guiding edge of the rail is in a range of about 0.001 m-0.06 m.

26. The method according to claim 24, wherein a second sensor is interconnected in front of the second wheel and the first wheel is interconnected to the second wheel via a steering rod, wherein the first sensor and a second sensor attached to the second hub each has an individual neutral position to which a displacement is measured and communicated to the control unit which calculates target positions out of a mean of the measured displacements of the first sensor and the second sensor.

27. The method according to claim 26 wherein a. a third sensor is attached behind the first wheel, and b. a fourth sensor is attached behind the second wheel, c. wherein each of the first sensor, the second sensor, the third sensor and the fourth sensor measures its displacement in respect to an individual neutral position and communicates the same to the control unit, d. and the control unit is i. using the measured displacements of the first sensor and the second sensor to calculate first target positions for the first sensor and the second sensor, wherein absolute values of the displacement of the first sensor and the second sensor are equal, ii. using the measured displacements the first sensor and the third sensor to calculate second target positions of the first sensor and the third sensor, wherein the displacements of the first sensor and the third sensor are equal, iii. using the measured displacements the second sensor and the fourth sensor to calculate third target positions of the second sensor and the fourth sensor, wherein the displacements of the second sensor and the fourth sensor are equal, iv. determining a correcting steering angle by which the actuator steers the first wheel and the second wheel in a defined position, v. wherein in the defined position 1. The first sensor and the second sensor are one of the first target positions, 2. And the first sensor and the third sensor are in one of the second target positions, 3. and the second sensor and fourth sensor are in one of the third target positions.

* * * * *